US009885333B2

(12) United States Patent
Gutscher et al.

(10) Patent No.: US 9,885,333 B2
(45) Date of Patent: Feb. 6, 2018

(54) METHOD AND DEVICE FOR SUPPLYING FUEL TO AN INTERNAL COMBUSTION ENGINE

(75) Inventors: Andreas Gutscher, Markgroeningen (DE); Andreas Posselt, Muehlacker (DE); Marko Lorenz, Grossbottwar (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1100 days.

(21) Appl. No.: 13/703,247

(22) PCT Filed: May 18, 2011

(86) PCT No.: PCT/EP2011/058069

§ 371 (c)(1),
(2), (4) Date: Feb. 15, 2013

(87) PCT Pub. No.: WO2011/154232

PCT Pub. Date: Dec. 15, 2011

(65) Prior Publication Data

US 2013/0139789 A1 Jun. 6, 2013

(30) Foreign Application Priority Data

Jun. 10, 2010 (DE) ..... 10 2010 029 935

(51) Int. Cl.
*F02M 69/04* (2006.01)
*F02D 41/04* (2006.01)
(Continued)

(52) U.S. Cl.
CPC ..... *F02M 69/04* (2013.01); *F02D 41/04* (2013.01); *F02D 41/3094* (2013.01); *F02D 41/365* (2013.01)

(58) Field of Classification Search
CPC ..... F02M 69/044; F02M 35/10321; F02M 69/04; F02M 69/042; F02D 1/00;
(Continued)

(56) References Cited

U.S. PATENT DOCUMENTS 4,548,175 A * 10/1985 Kawai ..... F01L 1/26 123/188.14
5,027,778 A * 7/1991 Nogi ..... F02D 43/00 123/472
(Continued)

FOREIGN PATENT DOCUMENTS

DE 10 2009 000894 10/2009
DE 10 2008 044244 6/2010
(Continued)

OTHER PUBLICATIONS

PCT ISA Written Opinion.*

*Primary Examiner* — Stephen K Cronin
*Assistant Examiner* — Susan Scharpf
(74) *Attorney, Agent, or Firm* — Norton Rose Fulbright US LLP; Gerard Messina

(57) ABSTRACT

A method and a device for supplying fuel into a combustion chamber of a cylinder of an internal combustion engine, in which an air-fuel mixture is supplied to the cylinder via at least two intake sections, which are connected to the cylinder via an intake valve, and each of the intake sections is assigned an injector, fuel being injected into the intake sections in at least intermittently asynchronous manner.

7 Claims, 2 Drawing Sheets

(51) Int. Cl.
*F02D 41/30* (2006.01)
*F02D 41/36* (2006.01)

(58) Field of Classification Search
CPC ..... F02D 9/00; F02D 41/04; F02D 41/3094; F02D 41/365; F02D 41/047; F02B 27/02
USPC ..... 123/184.21–184.27, 184.43–184.49, 445
See application file for complete search history.

(56) References Cited

U.S. PATENT DOCUMENTS 6,659,054 B2 * 12/2003 Sugiyama ..... F01L 1/022 123/478
7,195,000 B2 * 3/2007 Kayama ..... F02M 35/10216 123/302
7,909,025 B2 * 3/2011 Pagot ..... 123/559.1
2006/0272623 A1 * 12/2006 Pagot ..... F01L 1/26 123/559.1
2009/0084339 A1 * 4/2009 Oomura ..... F02M 61/1853 123/193.2
2009/0241904 A1 * 10/2009 Sugiyama ..... F02M 55/005 123/468
2009/0241905 A1 * 10/2009 Tomiita ..... F02M 35/10177 123/470
2009/0248275 A1 * 10/2009 Ichihara ..... F02D 29/02 701/103
2011/0079198 A1 * 4/2011 Moessner et al. ..... 123/445
2013/0139789 A1 * 6/2013 Gutscher et al. ..... 123/445
2016/0115876 A1 * 4/2016 Hoshi ..... F02D 41/345 123/90.15

FOREIGN PATENT DOCUMENTS

EP 1 726 805 11/2006
EP 1 930 565 6/2008
EP 1930565 A1 * 6/2008 ..... F02B 25/22
FR 2 720 113 11/1995
FR 2 720 114 11/1995
FR 2720113 A1 * 11/1995 ..... F02D 3/00
JP 2005-180285 7/2005
JP 2006-299945 11/2006
JP 2009-185741 8/2009
JP 2010-24969 2/2010
JP 2010-121617 6/2010

* cited by examiner

METHOD AND DEVICE FOR SUPPLYING FUEL TO AN INTERNAL COMBUSTION ENGINE

FIELD OF THE INVENTION

The present invention relates to internal combustion engines, in which fuel is injected into an intake manifold with the aid of two injectors. More specifically, the present invention relates to an actuation method for injecting fuel with the aid of two injectors in an internal combustion engine.

BACKGROUND INFORMATION

Internal combustion engines in which two injectors are provided for each cylinder in an intake manifold are already known. Eight injectors may therefore be provided in such a four-cylinder spark-ignition engine. The two injectors assigned to an individual cylinder inject fuel into a region of a branching point of the intake manifold in order to admit a fuel-air mixture formed there into the particular cylinder through two separate intake valves. For internal combustion engines having two intake valves per cylinder, this has the advantage that less fuel is directed toward a bridge at the branching point of the intake manifold and deposited there than in internal combustion engines having only a single injector per cylinder. The deposited fuel quantity is difficult to ascertain, so that the dosing of the precise quantity of the fuel admitted into the cylinder becomes more difficult.

One aspect in the construction of an injection systems for an internal combustion engine is that a homogeneous fuel-air mixture is present in the cylinder of the internal combustion engine at the ignition instant. In conventional internal combustion engines this air-fuel mixture is produced in the area in front of the intake valves. The fuel spray injected by the injectors into the corresponding intake manifold region evaporates there and is aspirated into the individual cylinder by a corresponding piston movement at the intake instant. Toward this end, the injection of the fuel into the corresponding intake-manifold section usually takes place ahead of time, so that a certain period of time is available for the evaporation of the fuel droplets in the fuel spray. This is required especially in the operating ranges that feature higher loads.

SUMMARY OF THE INVENTION

It is an objective of the exemplary embodiments and/or exemplary methods of the present invention to provide a method and a device for supplying fuel into a cylinder of an internal combustion engine, which allow better mixing of the air-fuel mixture in the cylinder.

This object is attained by the method for supplying fuel into a combustion chamber of a cylinder of an internal combustion engine as described herein, and by the device and the engine system as described herein.

Further advantageous developments are indicated in the further descriptions herein.

According to a first aspect, a method for supplying fuel into a combustion chamber of a cylinder of an internal combustion engine is provided, in which an air-fuel mixture is supplied to the cylinder via at least two intake sections, each of which is connected to the cylinder via a separate intake valve; each intake section is assigned an injector, and fuel is injected into the intake sections at least intermittently in asynchronous manner.

One idea of the aforementioned method in the case of a combustion engine in which the injection of fuel into the intake manifold is implemented by two separately actuable injectors, is to perform the injection in such a way that the evaporation of the fuel spray at least partially takes place inside the cylinders.

Another idea is to increase the evaporation rates in advance injections as well. To do so, the injection of the fuel into the intake manifold is likewise carried out during the time window in which the intake valves open, in addition to the current advance injection. To avoid the usual disadvantages this entails, such as an inhomogeneous distribution of the air-fuel mixture in the cylinder or an incomplete evaporation of the fuel spray at the ignition instant, an asynchronous actuation of the injectors is provided in addition, so that better turbulence is achieved in the fuel in the cylinders or in the intake manifold, and thus better mixing of the air-fuel mixture. Among other things, this results in a better evaporation rate in the fresh mixture.

Another advantage of this operating mode is that the internal combustion engine may be operated at a higher exhaust-gas recirculation rate (EGR rate) in the part throttle range, which in turn reduces the consumption.

Moreover, it is also possible that only one of the intake valves injects fuel into the corresponding intake section during an injection phase.

According to one specific embodiment, an injector is able to inject fuel into the intake section for a particular period of time, the period having a length that corresponds to between 2% to 30% of the length of the injection phase of the injectors.

In particular, fuel may be injected into the intake sections in alternation.

Furthermore, fuel is able to be injected into the intake sections only in advance of an intake time window during which the individual intake valves into the cylinder are open, or only during the intake time window, or in advance of and during the intake time window.

According to another aspect, a device is provided for controlling the supply of fuel into a combustion chamber of a cylinder of an internal combustion engine, and an air-fuel mixture is supplied to the cylinder by way of at least two intake sections, which are connected to the cylinder via an individual intake valve, and each of the intake sections is assigned an injector. The device is configured to actuate the injectors in such a way that fuel is injected into the intake sections at least intermittently in asynchronous manner.

According to another aspect, an engine system having an internal combustion engine and having the above device is provided.

According to another aspect, a computer program product is provided, which includes program code which implements the above method when it is executed on a data processing unit.

Specific embodiments are explained in greater detail in the following text on the basis of the attached drawings.

DETAILED DESCRIPTION

Figure 1:
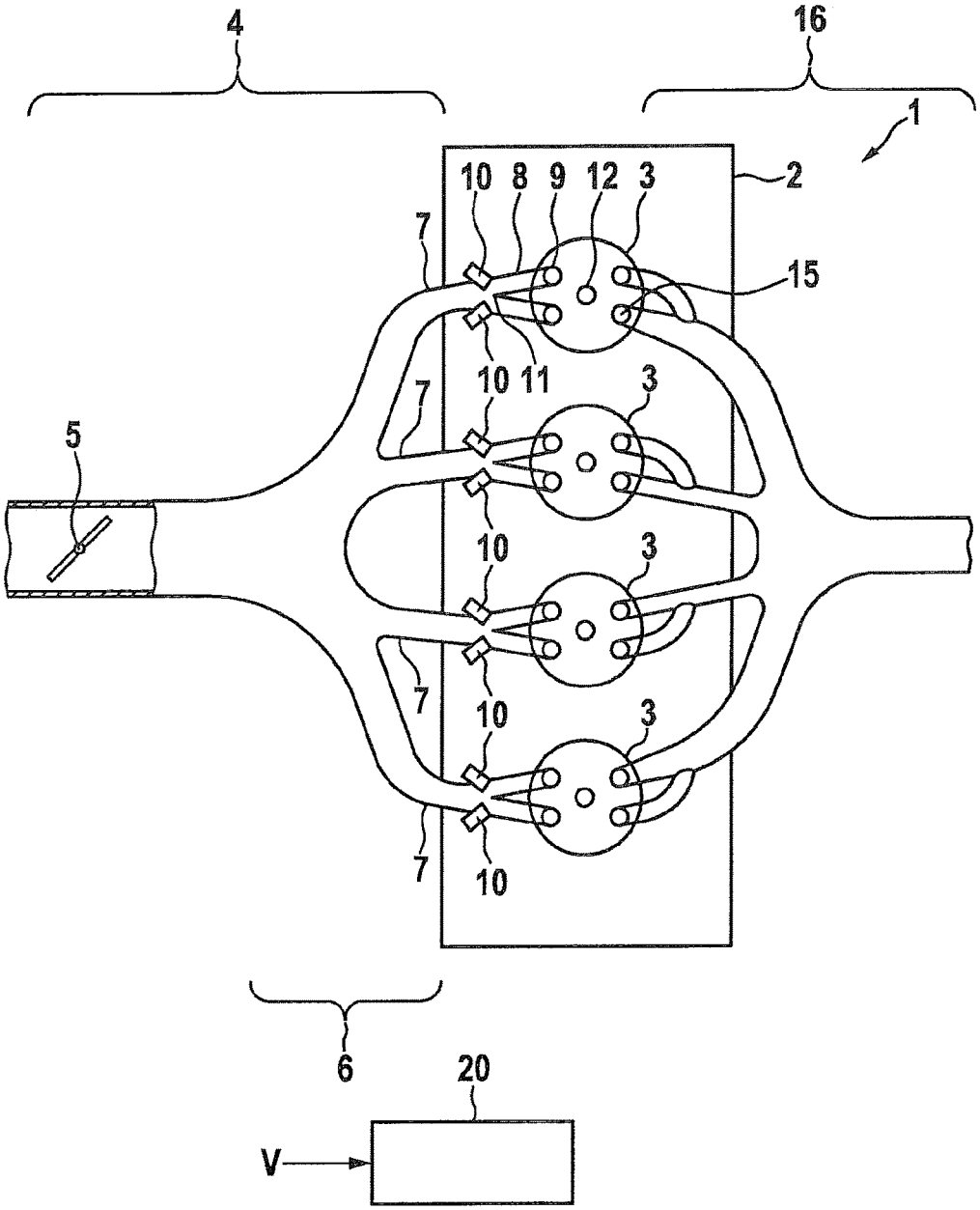
FIG. 1 shows a schematic representation of an engine system having an internal combustion engine, to which fuel is supplied through an intake manifold injection using two injectors per cylinder.

FIG. 1 shows an engine system 1 having an internal combustion engine 2. In the exemplary embodiment described, internal combustion engine 2 is an Otto engine, but it may include other types of internal combustion engines 2. In the exemplary embodiment shown, internal combustion engine 2 has four cylinders 3. The number of cylinders 3 is not restricted to four, but any other number of cylinders 3 may be provided in internal combustion engine 2.

In the known manner, a combustion stroke, an exhaust stroke, an intake stroke, and a compression stroke according to a four-stroke operation are implemented in cylinders 3.

Cylinders 3 are supplied with fresh air via an air-supply system 4. A throttle valve 5 is situated in air-supply system 4 in order to adjust the supplied air quantity in accordance with a predefined actuation. The region between throttle valve 5 and cylinders 3 is called the intake manifold. Air-supply system 4 branches to form a multiplicity of cylinders 3 in a region 6 of the intake manifold, downstream from throttle valve 5. In the exemplary embodiment at hand, air supply system 4 branches to form four supply sections 7. Before the air supplied via air-supply sections 7 is admitted into cylinders 3, air-supply section 7 branches to form two intake sections 8, which terminate at the individual cylinder 3. The air supplied via intake sections 8 is routed into individual cylinder 3 during suitable intake time windows, with the aid of intake valves 9 situated on individual cylinder 3.

Injectors 10 are provided directly upstream from the point where air-supply section 7 branches into intake sections 8. In relation to intake sections 8, injectors 10 are placed in such a way that the spray cone of the fuel spray they inject reaches into the individual intake section 8 when fuel is injected, so that as little fuel as possible is able to deposit on a bridge 11 at the branching point of supply section 7.

The air-fuel mixture admitted into cylinders 3 via intake valves 9 is ignited at an ignition point specified according to the control, using an ignition device 12. The combustion triggered in this fashion causes an expansion of the combustion chamber as a result of a corresponding movement of a piston (not shown) situated inside cylinders 3 and thereby induces a drive torque of internal combustion engine 2.

In the following exhaust stroke, the size of the combustion chamber of individual cylinder 3 is reduced again in that the piston executes a compression motion. During this exhaust stroke movement, one or multiple (two, in the case at hand) discharge valve(s) 15 is/are opened, which causes the combustion gases present in cylinder 3 to be expelled into an exhaust recirculation section 16. The combustion gases are then discharged into the environment via a possibly provided catalytic converter (not shown).

Engine system 1 is operated with the aid of a control unit 20, in accordance with a specification V, which may correspond to a drive torque to be provided, for example. For instance, this specification may represent a torque desired by the driver, if engine system 1 is an engine system of a motor vehicle. The actuation by control unit 20 takes place by setting actuators, such as the throttle valve actuator for the adjustment of throttle valve 5, or injectors 10, for which an injection instant and the injection duration are specified, or the ignition device for igniting ignition device 12, for which an ignition instant is specified, as well as other actuators.

The actuation is implemented as a function of input V and of state variables of engine system 1, which are able to be acquired by corresponding sensors and/or may be modeled based on other state variables and/or their dynamic behavior. Such state variables may be, for example, the intake manifold pressure inside the intake manifold, the engine speed of internal combustion engine 2, the load of internal combustion engine 2, the exhaust gas temperature and other state variables.

In a conventional actuation of an internal combustion engine having such a configuration, i.e., two injectors in an intake manifold that branches into two intake sections, the injection is usually implemented ahead of time. In other words, fuel is injected into intake sections 8 before intake valves 9 admit the air-fuel mixture into cylinders 3.

Figure 2:
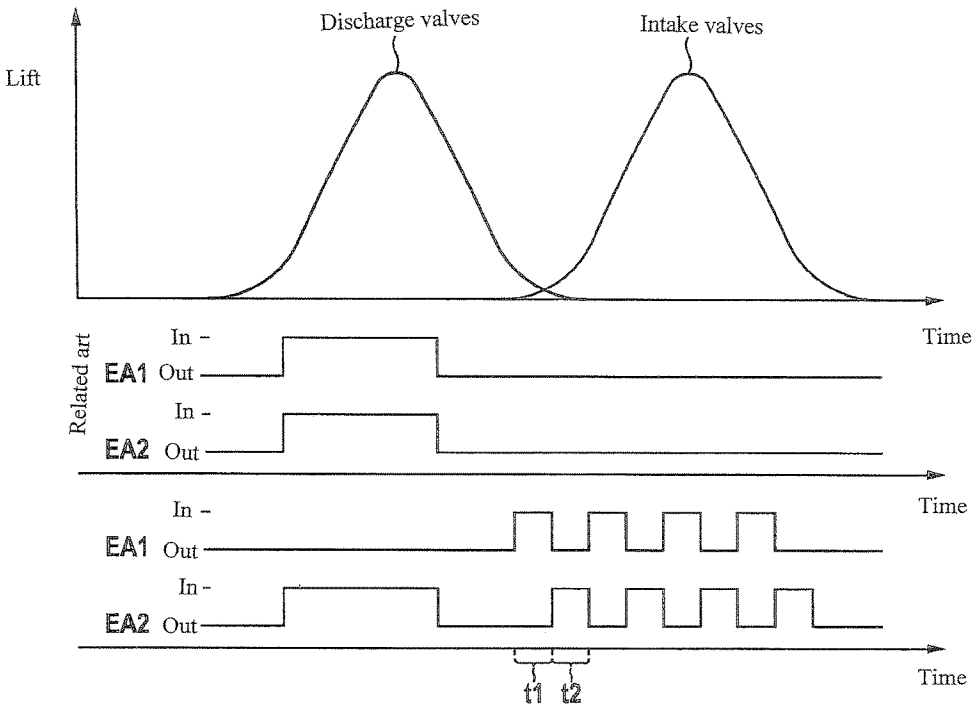
FIG. 2 shows a comparison between the fuel injection in the related art and the fuel injection according to a specific embodiment of the method for supplying fuel.

An illustration of such an injection is shown in the upper portion of FIG. 2. There, the temporal characteristics of valve lifts ENW of the intake valves and valve lifts ANW of the discharge valves are shown. With temporal reference thereto, actuating signals EA1, EA2 for the injectors are shown underneath, in an advance injection according to the related art. Illustrated at the very bottom are actuating signals EA1, EA2 for the injectors in an injection according to the method provided here.

In the method according to the related art, the two injectors 10 assigned to a cylinder 3 are actuated simultaneously prior to opening intake valves 9. This causes the entire fuel quantity to be injected into the intake manifold or into intake sections 8, prior to opening intake valves 9. In this way nearly the entire fuel is able to evaporate in intake section 8 already before intake valves 9 are opened, and the fully prepared air-fuel mixture is able to be admitted into cylinder 3.

An improved operation also comes about, for example, if injectors 10 are actuated in asynchronous manner according to the lower illustration of the actuating signals of injectors 10. When the fuel flows into the combustion chamber, inhomogeneities are produced in the distribution of the air-fuel mixture, which may lead to an uneven combustion entailing worsened emission values. To achieve even better turbulence in the fuel spray in the combustion chamber, it is now provided that injectors 10 assigned to a particular cylinder 3 inject fuel spray at different time periods.

This asynchronous actuation may take place prior to and/or during the phase in which intake valves 9 are open. This produces turbulence. At least a portion of the fuel spray makes its way into the combustion chamber of individual cylinder 3 and first evaporates once it has arrived in that location, which provides for overall cooling of the the combustion chamber. In this way, the knocking tendency of internal combustion engine 2 is able to be reduced considerably, especially at full loads.

According to one specific embodiment, the injection may take place in alternation, as shown in FIG. 2. Beginning with a first one of injectors 10, an injection of fuel is carried out for a first injection period t1. After first injection period t1 has elapsed, the fuel injection by first injector 10 is terminated, and a second one of injectors 10 injects fuel for a second time period t2. After second time period t2 has ended, another injection using first injector 10 takes place, and the process repeats itself. This alternating injection may be performed throughout the entire phase during which the injection of fuel is to take place. First and second time periods t1, t2 may have the same length or different lengths. First and second time periods t1, t2 may correspond to a time period between 2% and 30% of the length of the entire injection phase, which may be between 10 and 20% of the duration of the entire injection phase.

It may furthermore be provided that the injection also take place during partially overlapping time windows. To achieve the desired additional turbulence in the fuel spray when it is admitted into the combustion chamber of the cylinder, no simultaneous injection of fuel by both injectors 10 may take place during a time window within the opening phase of injectors 9.

What is claimed is:

1. A method for supplying fuel into a combustion chamber of a cylinder of an internal combustion engine, the method comprising:

supplying an air-fuel mixture to the cylinder via at least two intake sections, which are connected to the cylinder via an intake valve, and each of the intake sections is assigned a different injector; and for each injection phase, injecting fuel into the intake sections at least intermittently asynchronously, wherein at least a first injection from a first injector into a first intake section is prior to the intake valve opening and a first injection from a second injector into a second intake section is during the intake valve opening, and wherein subsequent injections from the first and second injectors take place in alternation during the intake valve opening.

2. The method of claim 1, wherein each injector injects fuel into the intake sections for a particular period of time, the period having a length that corresponds to between 2% to 30% of the length of the injection phase of the injectors.

3. The method of claim 1, wherein fuel is injected into the intake sections in alternation, wherein the end time of injection into the first intake section of the cylinder is different from the end time of the injection into the second intake section of the cylinder.

4. The method of claim 1, wherein fuel is injected into the intake section one of (i) only in advance of an intake time window during which the intake valves into the cylinder are open, (ii) only during the intake time window, or (iii) in advance of and during the intake time window.

5. A device for controlling a supply of fuel into an internal combustion chamber of a cylinder of an internal combustion engine, comprising:

a supply arrangement to supply the cylinder with an air-fuel mixture via at least two intake sections, which are connected to the cylinder via an intake valve, and each of the intake sections is assigned a different injector; and an actuating arrangement to actuate the injectors so that the fuel is injected, for each injection phase, into the intake section in at least an intermittently asynchronous manner, wherein at least a first injection from a first injector into a first intake section is prior to the intake valve opening and a first injection from a second injector into a second intake section is during the intake valve opening, and wherein subsequent injections from the first and second injectors take place in alternation during the intake valve opening.

6. An engine system, comprising:

an internal combustion engine; and a device for controlling a supply of fuel into an internal combustion chamber of a cylinder of an internal combustion engine, including:

a supply arrangement to supply the cylinder with an air-fuel mixture via at least two intake sections, which are connected to the cylinder via an intake valve, and each of the intake sections is assigned a different injector; and an actuating arrangement to actuate the injectors so that the fuel is injected, for each injection phase, into the intake section in at least an intermittently asynchronous manner, wherein at least a first injection from a first injector into a first intake section is prior to the intake valve opening and a first injection from a second injector into a second intake section is during the intake valve opening, and wherein subsequent injections from the first and second injectors take place in alternation during the intake valve opening.

7. A computer readable medium having a computer program, which is executable by a processor, comprising:

a program code arrangement having program code for supplying fuel into a combustion chamber of a cylinder of an internal combustion engine, by performing the following:

supplying an air-fuel mixture to the cylinder via at least two intake sections, which are connected to the cylinder via an intake valve, and each of the intake sections is assigned a different injector; and for each injection phase, injecting fuel into the intake sections at least intermittently asynchronously, wherein at least a first injection from a first injector into a first intake section is prior to the intake valve opening and a first injection from a second injector into a second intake section is during the intake valve opening, and wherein subsequent injections from the first and second injectors take place in alternation during the intake valve opening.

* * * * *